United States Patent [19]

Allen, Jr.

[11] Patent Number: 4,625,804

[45] Date of Patent: Dec. 2, 1986

[54] REMOTELY RELEASABLE TEMPLATE AND DOME

[75] Inventor: Grady G. Allen, Jr., Rosenberg, Tex.

[73] Assignee: Grady Allen Survey Consultants, Inc., Rosenberg, Tex.

[21] Appl. No.: 709,604

[22] Filed: Mar. 7, 1985

[51] Int. Cl.[4] ..... E02D 5/54; E21B 7/12

[52] U.S. Cl. ..... 166/338; 166/341; 405/195

[58] Field of Search ..... 166/338–342, 166/349, 365, 79, 85, 94; 405/202, 195, 224

[56] References Cited

U.S. PATENT DOCUMENTS

| | | | |
|---|---|---|---|
| 3,302,709 | 2/1967 | Postlewaite | 166/0.6 |
| 3,353,595 | 11/1967 | Nelson | 166/0.6 |
| 3,732,923 | 5/1973 | Fowler | 166/0.6 |
| 4,126,183 | 11/1978 | Walker | 166/338 |
| 4,174,011 | 11/1979 | Zaremba | 166/341 |
| 4,497,592 | 2/1985 | Lawson | 166/341 |

OTHER PUBLICATIONS

Frank R. Carmichael, *Offshore Drilling Technology* (Park Ridge: Noyes Data Corp 1975), pp. 50–55.

*Primary Examiner*—Stephen J. Novosad
*Assistant Examiner*—Bruce M. Kisliuk
*Attorney, Agent, or Firm*—Marsteller & Associates

[57] ABSTRACT

An apparatus (A) and method for precision placement of a template (T) of the type having at least one sleeve member (20) for placing about a well casing stub (W) extending from the sea floor (S) includes semi-rigidly coupling a mating means (M) mounted with the template (T) for demountably coupling the template (T) to a complementary end (E) of a drill string (D). The drill string (D) is then lowered from a vessel (V) above the well casing (W) with the template (T) demountably coupled thereto until the template (T) is in proximity to the sea floor (S). The orientation of a selected axis of the template (22) is then determined relative to a desired heading (24). The drill string (D) is rotated about its vertical axis (26) until the desired orientation of the template is achieved. The drill string (D) is then lowered until the template (T) contacts the sea floor (S) when the drill string (D) is remotely released from the template (T).

14 Claims, 13 Drawing Figures

REMOTELY RELEASABLE TEMPLATE AND DOME

BACKGROUND OF THE INVENTION

1. Field of the Invention

This invention relates to the field of offshore or marine wells and operations performed from a platform on the surface of the water, and more particularly it relates to methods for positioning and placing without the use of underwater divers a template or dome used in conjunction with the offshore well.

2. Description of Related Art

Heretofore templates and domes have been used in connection with offshore or marine oil or gas wells. Petroleum wells have been drilled through a sea floor template. See Frank R. Carmichael, *Offshore Drilling Technology* (Park Ridge: Noyes Data Corporation, 1975), pp. 50–55 and other pages therein. Templates have also been known as guide bases since templates act as a guide for equipment such as the oil or gas well production tree as well as providing a guide base for mounting of the platform or vessel on the surface of the water. The purpose of the template is to provide correct spacing between the wells in order that they will line-up with the conductor guides in the platform jacket.

Prior to the present invention the placement or the orientation of templates to the desired heading was relatively inaccurate and required the assistance of underwater divers. Typically, a template would be suspended by steel cables or chains from the end of a drill string extending beneath the surface vessel. The drill string would be lowered until the template reached the proximity of the sea floor and then the divers, using magnetic compasses, would man-handle the template until it was in the approximate orientation relative to the desired magnetic or true bearing. Following the shoving of the template into position, the drill string would be further extended until the template rested upon the sea floor when the divers would then be called upon to disconnect the template from the drill string. Because this operation is frequently conducted at water depths in excess of 300 feet or 100 meters, the time available for the divers to operate at that depth was limited. Moreover, the template and drill string, which are metal, would tend to influence magnetic compasses reducing the accuracy of the orientation. Normally, this type of prior operation resulted in the placement of the template only within five (5) degrees to fifteen (15) degrees of the desired heading.

It was also known to place a gyroscopic device down a drill string through its inner bore to determine the orientation of a tool or element mounted near the end of the drill string. The gyroscope would determine the orientation of the tool or element when the end of the drill string is at some distance from the surface vessel.

With the present invention underwater divers are not required and thus reduces the amount of time needed for this operation and eliminates an added expense. Moreover, the orientation of the template when placed using the present invention is accurate to within one (1) degree of the desired heading.

Nelson et. al., U.S. Pat. No. 3,353,595, relates to methods and apparatus for completing offshore wells in which the wellhead is located at an underwater level. It is of interest for its disclosure of J-slots 29.

Fowler, U.S. Pat. No. 3,732,923, discloses a method and apparatus for remotely connecting flowlines to an underwater wellhead, and Walker, U.S. Pat. No. 4,126,183 teaches an offshore well apparatus with a protected production system. Both Fowler and Walker disclose a J slot-lug combination in FIGS. 17 and 11 respectively. However, neither patent discloses any means for lowering and orienting a template using such means.

Postlewaite, U.S. Pat. No. 3,302,709, discloses a method for attaching and detaching a working base to an underwater well base and is cited only because of its disclosure of a "bayonet" type latch (see FIG. 28).

Domes have been used in the past to protect a well casing stub from damage as well as to prevent the stub from causing damage to fishing nets. After a well is drilled there is a period of time before the well is put into production. When the drilling vessel leaves, the oil well casing is terminated above the level of the sea floor leaving the oil well casing stub. Geodesic domes are then positioned over the stub for protection. While the orientation of the dome in not as critical as it is for a template, domes were normally placed by a similar method to that used for templates.

SUMMARY OF THE INVENTION

The present invention relates to a new and improved template assembly and method for precision placement of a template of the type having at least one sleeve member for placing about a well casing stub extending from the sea floor includes semi-rigidly coupling a mating means mounted with the template for demountably coupling the template to a complementary end of a drill string. The drill string is then lowered from a vessel above the well casing with the template demountably coupled thereto until the template is in proximity to the sea floor. The orientation of a selected axis of the template is then determined relative to a desired heading. The drill string is rotated about its vertical axis until the desired orientation of the template is achieved. The drill string is then lowered until the template contacts the sea floor when the drill string is remotely released from the template.

The present remotely releasable template uses no underwater divers to either determine the orientation of the template or to move the template into the desired orientation with respect to a preselected magnetic or true bearing. The elimination of the underwater divers reduces the time previously needed to position a template as well as lowering relates costs and risks. The present method and apparatus also reduces the deviation from the selected orientation that templates may be placed.

DESCRIPTION OF THE PREFERRED EMBODIMENT(S)

The Template

Figure 1:
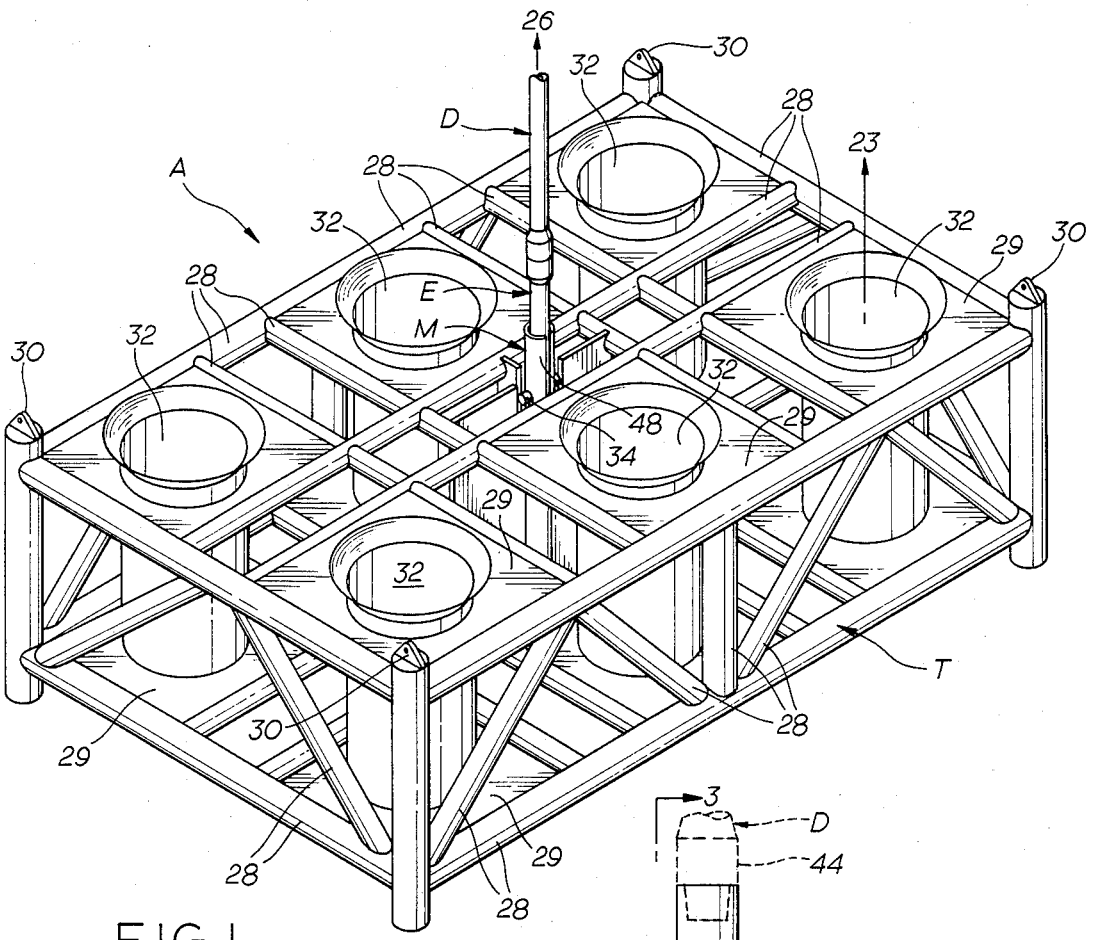
FIG. 1 is a perspective view of the template assembly of the present invention.

In the drawings identical numbers represent similar elements. Referring to the figures, the letter A refers generally to the template assembly of the present invention that is a template T adapted for remote release from being semi-rigidly coupled to the end E of a drill string S. Briefly, the template assembly A includes a template T of the type having at least one sleeve member 20 for placing about a wall casing stub W extending from the sea floor S. Mating means M mounted with the template T demountably couples the template T to a complementary end E of a drill string D extending from a support structure V located above the well casing stub W. The vertical axis 26 of the drill string D is essentially parallel to the longitudinal axis 23 of the sleeve member 20 when the drill string D is demountably coupled to the template assembly A. The mating means M maintains the template T semi-rigidly coupled to the drill string D until the template T is controllably released from the drill string D.

Figure 2:
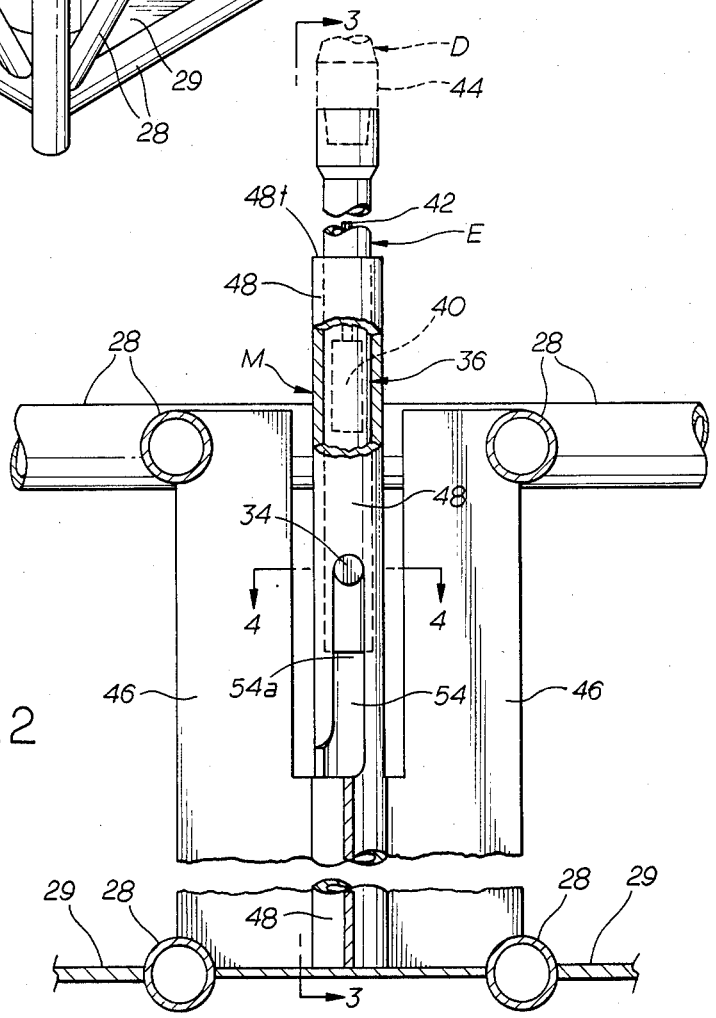
FIG. 2 is a side view of the mating means.
Figure 3:
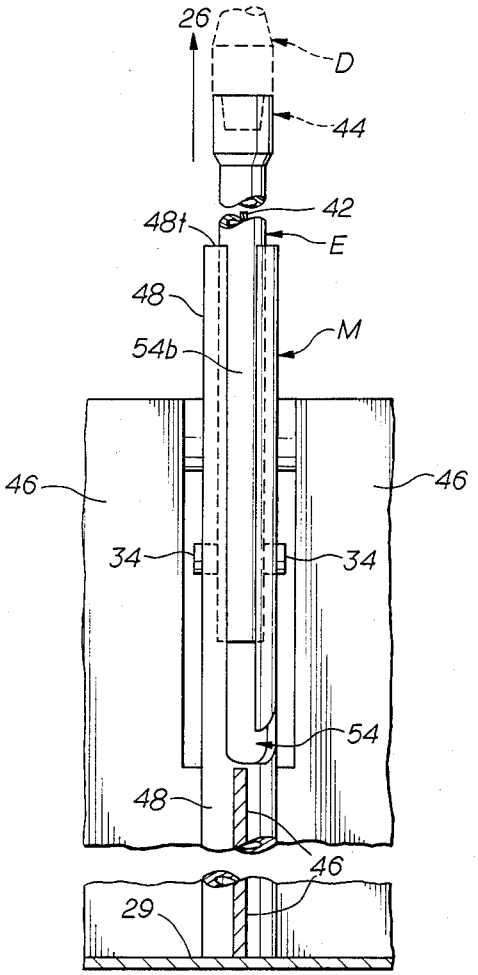
FIG. 3 is a cross-sectional view of the invention along line 3—3 of FIG. 2.
Figure 4:
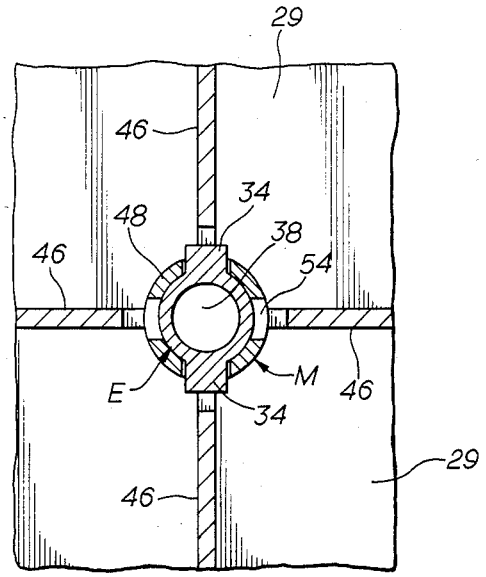
FIG. 4 is a cross-sectional view of the invention along line 4—4 of FIG. 2.
Figure 5:
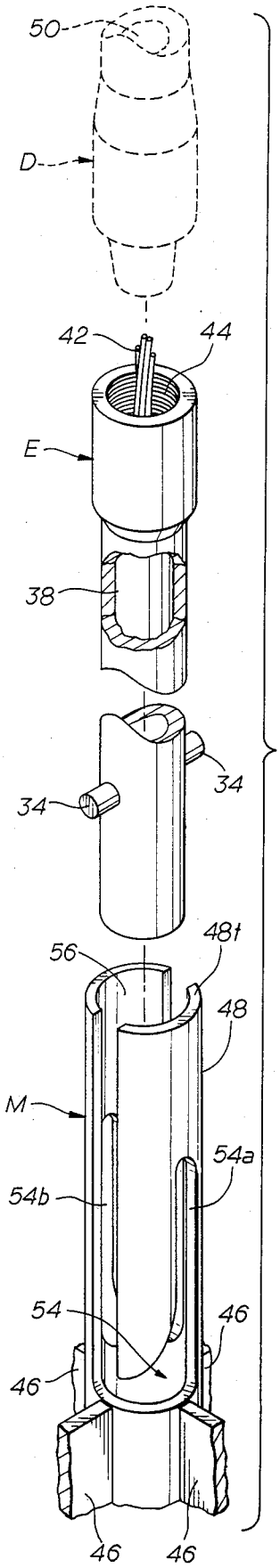
FIG. 5 is a perspective view of a complementary end of a drill string.

Referring now to FIG. 1, a known template T has at least one sleeve 32 through which the oil well casing stub W can be positioned. A plurality of cross braces 28 and plates 29 join the sleeves 32 and form the template T. Guides 30 are formed on the top of braces 28 at the corners of the template T. A mating means M is mounted with the template T at or near the center of balance for the template assembly A. The mating means M can best be described with reference to FIG. 2.

The mating means M preferably comprises a tubular section 48 securely mounted to the template T by means of braces 46. Tubular section 48 has an inner bore 56 having a diameter sufficiently large to accommodate the diameter of the complementary end section E of the drill string D. The tubular section 48 desirably includes a J-slot formed in the walls to accept a pin or rod 34 mounted with the end E so as to semi-rigidly couple or engage the end section E within the mating means M. J-slot 54 includes two segments, a longer segment **54*b* that extends from the top 48*t* of the tubular segment 48 and a shorter segment 54*a* that does not reach the top 48*t*. Thus when the end E with pin 34 is to be mated or coupled with mating means M, the pin is inserted into the longer segment 54*b* and is turned or guided into the shorter segment 54*a* whereby the two pieces are demountably coupled together. The mounting means M is positioned with respect to the template T such that the longitudinal axis 23 of the sleeves 20 is essentially parallel to the vertical axis 26** of the drill string D.

The drill string D is well known in the art and the end section E generally is a separate section that is joined to the drill string D by means of the known threaded connector 44. Typically, the end section E is a tubular segment or a cylindrical body with an axial bore or groove 38 in it such that the bore 38 would be in communication with the bore 50 of the drill string D. A gyroscopic orientation means 36 can be formed with the end section E. Gyroscopic orientation means 36 generally includes a known gyroscopic assembly 40 used in oil production and exploration that can be passed through the bore 50 by means of a cable 42 extending from the vessel V. When the gyroscope 40 reaches the groove 38, the gyroscope is turned into alignment with the groove 38 which is itself in a previously determined orientation with reference to an axis 22 of the template assembly A. The gyroscope 40 determines the orientation of the template assembly A when it is coupled to the end segment E containing the gyroscopic orientation means 36.

Figure 9:
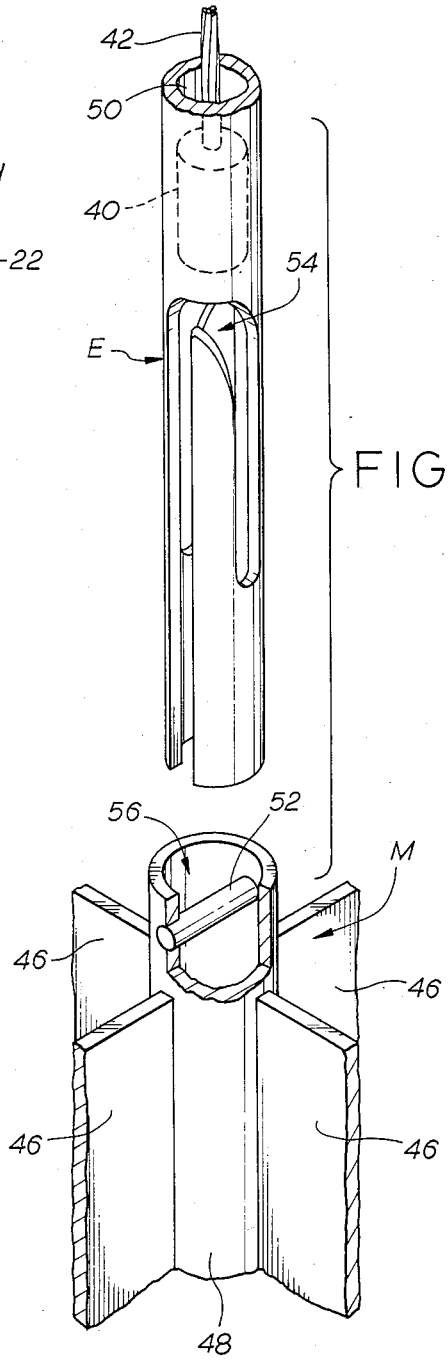
FIG. 9 is an alternative embodiment of the mating means of the present invention taken along line 3—3 of FIG. 2.

FIG. 9 is an alternative embodiment of the mating means M and the complementary end E of the present invention with the J-slot 54 formed in the end segment E and a rod or pin 52 formed in the bore 56 of the tubular section 48.

The Dome

Figure 13:
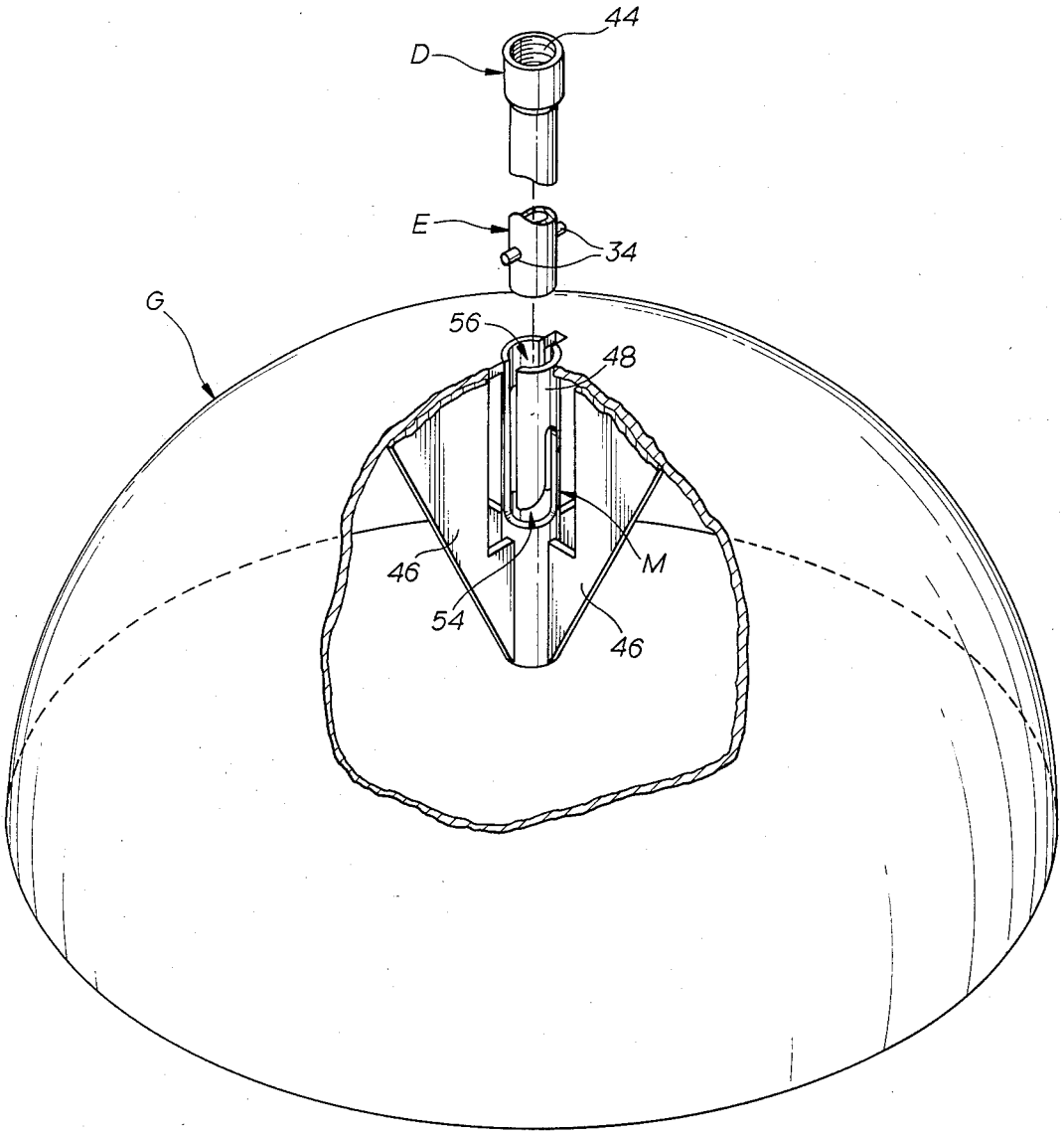

The dome of the present invention in FIG. 13 is a known geodesic dome G of the type used to encase oil well casing stubs W that extend from the sea floor S adapted to be remotely releasable by means of the mating means M described above with reference to the remotely releasable template of the present invention. Preferably, the top of the mating means M is flush with the outer surface of the dome G such that any fishing nets that are pulled across the dome G do not snag on any protruding elements or parts.

Operation

The operation or method of the present invention can best be explained with reference to FIGS. 6–8 and 10–12. Briefly, the method for precision placement of a template T of the type having at least one sleeve member 20 for placing about a well casing stub W extending from the sea floor S includes the steps of first semi-rigidly coupling a mating means M mounted with the template T for demountably coupling the template T to a complementary end E of a drill string D. The drill string D is then lowered with the template T demountably coupled thereto until the template T is in proximity to the sea floor S. The orientation of a selected axis 22 of the template T is determined relative to a desired magnetic or true heading or bearing 24. The drill string D is then rotated by use of a crown block or a rotary table on the vessel V about the vertical axis 26 of the drill string D until the desired orientation of the template T or template assembly A is achieved.

Figure 12:
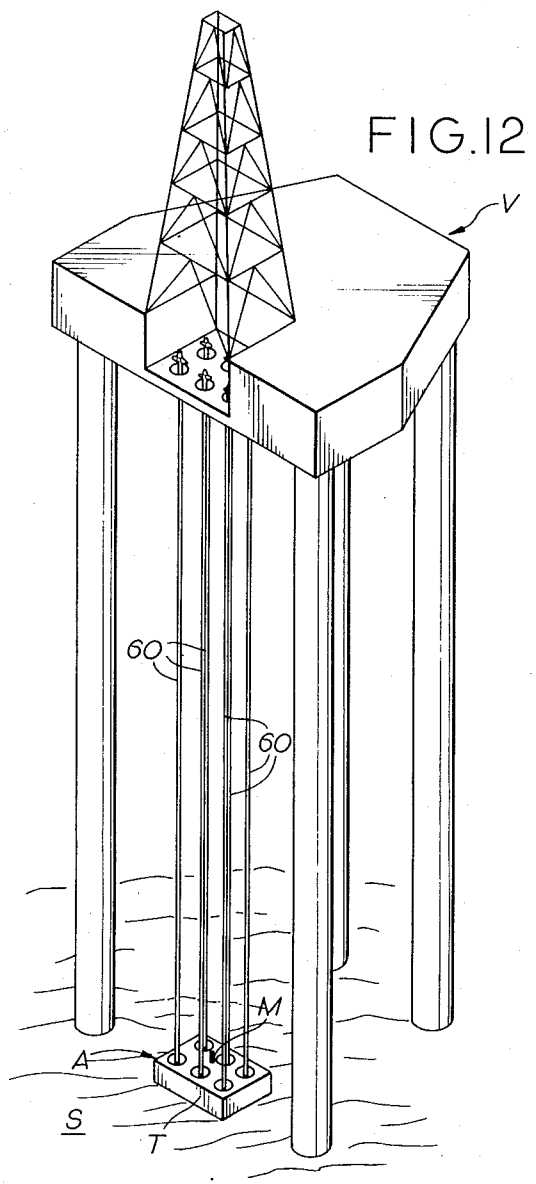
FIGS. 10–12 is a series of schematic drawings illustrating the present method of placing a template assembly; and, FIG. 13 is a perspective view of a dome of the present invention.
Figure 11:
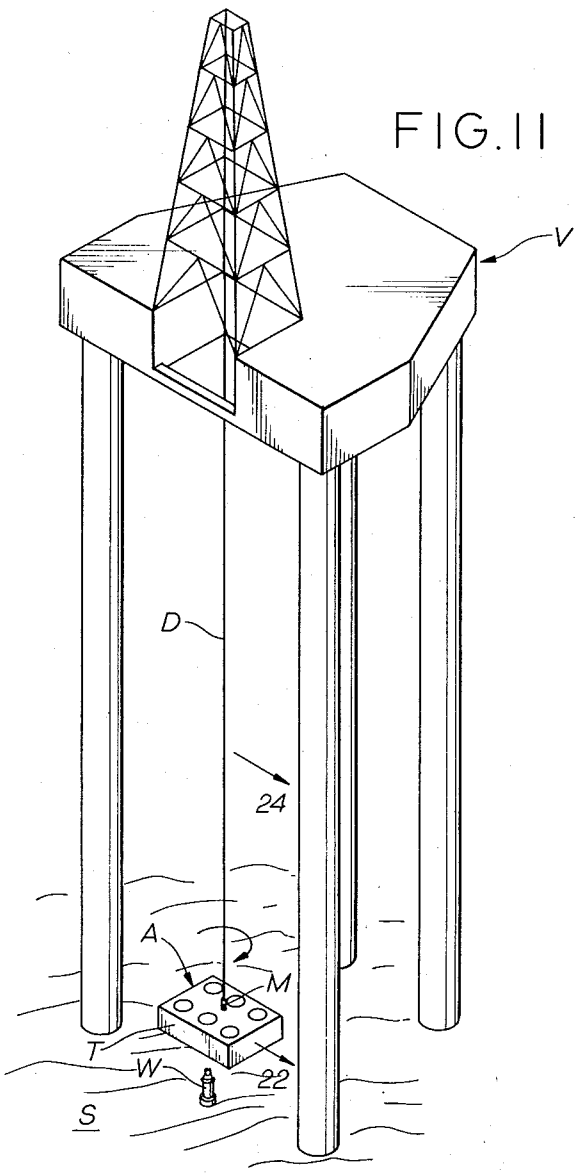
Figure 10:
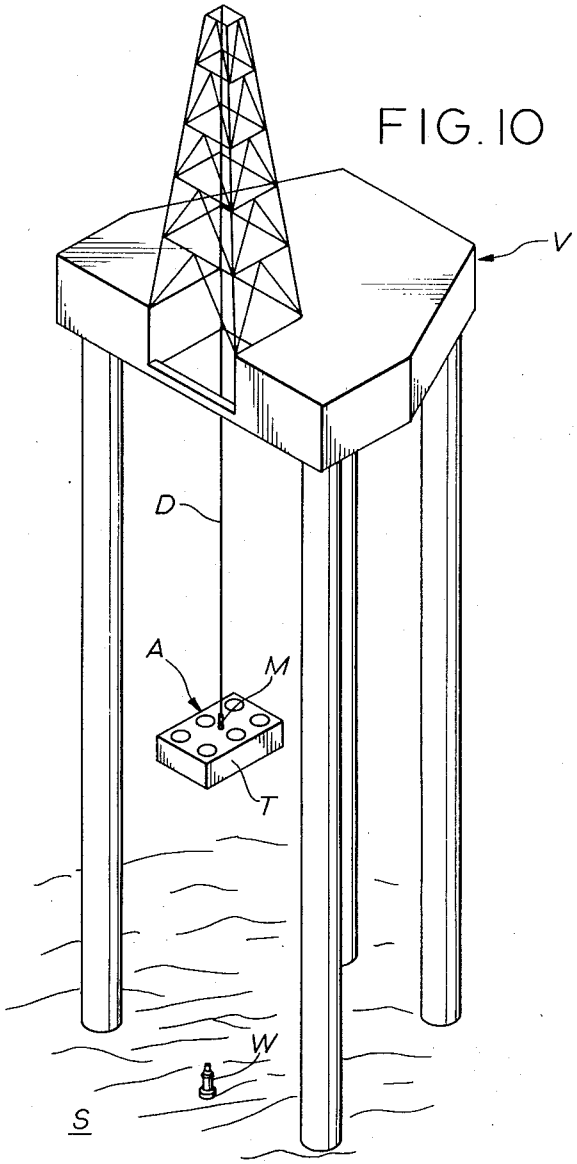

The end E of the drill string D is then lowered until the template assembly A contacts or rest upon the sea floor. Then the end E of the drill string D is remotely released from the mating means M of the template assembly A such as by first further lowering of the end E of the drill string D followed by a lifting of the drill string D out of engagement or coupling with the mating means M. Alternatively, if the end E of the drill string D is bolted onto the mating means M of the template assembly A, then the bolts would be released by activating an explosive charge contained within each bolt or by having an underwater diver undo the bolts. FIG. 12 shows a completed well with the template assembly A in place and with riser pipes 60 communicating the petroleum, oil or gas from the well to the platform or vessel V.

Typically, the determination of the orientation of the axis 22 of the template T would be done by lowering a known gyroscopic assembly 40 suspended from the cable 42 through the bore 50 of the drill string D until it reaches the end E of the drill string or some other tool attached to the drill string D. The end E has a groove 38 that orients the gyroscope 40 which can then be read from the vessel V. The step of taking the bearing or orientation of the template assembly A can be repeated as often as is necessary to accurately position the template assembly A with respect to the desired bearing 24.

Figure 6:
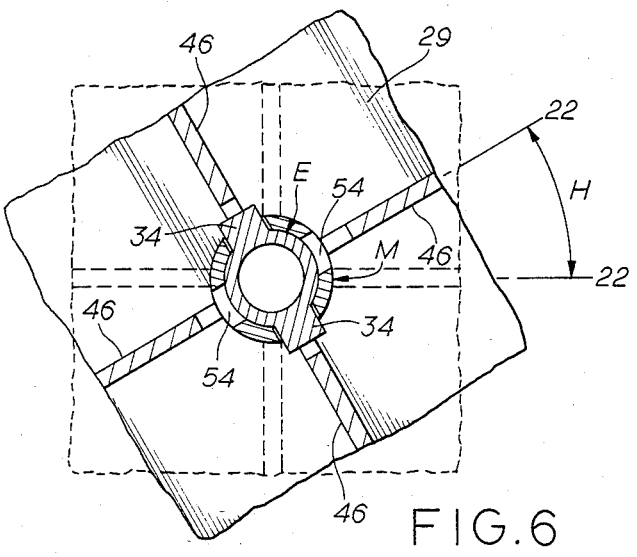
FIGS. 6–8 is a series of cross-sectional views along line 4—4 in FIG. 2 showing the orientation and remote release of the present invention.
Figure 7:
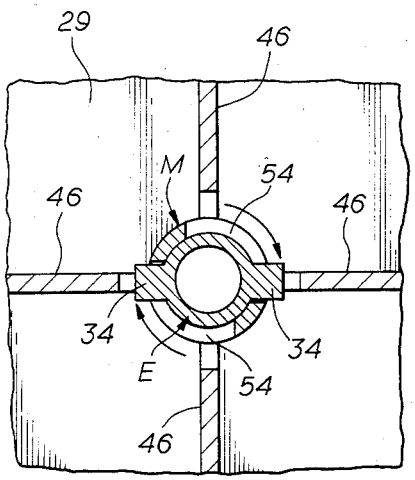
Figure 8:
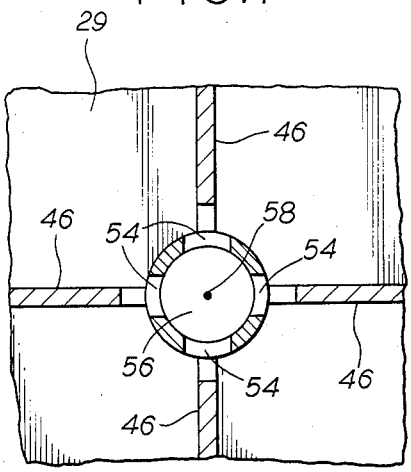

FIG. 6 through 8 disclose the sequence of the automatic uncoupling of the end E from the mating means M of the present invention. FIG. 6 shows that the axis 22 of the template assembly A was rotated through an angle H to achieve the desired orientation. After the template assembly A is placed on the sea floor S, the end E is further lowered and the pins 34 cooperating with the J-slot 54 rotate automatically the end E. When the drill string D is then withdrawn or raised, the pins guide the end E out of engagement with the mating means M without any other assistance. FIG. 8 shows the mating means M after the end E was uncoupled and that the center of balance 56 of the template assembly A lies within the bore 56 of the tubular section 48.

The method of placing the dome of the present invention is as has been described above with respect to the template, however, the precision with regard to orientation is not normally required. Therefore, the additional steps of precisely determining the heading is not usually needed.

The foregoing disclosure and description of the invention are illustrative and explanatory thereof, and various changes in the size, shape and materials, as well as in the details of the illustrated construction may be made without departing from the spirit of the invention.

I claim:

1. A remotely releasable template assembly for precision placement of a template of the type having at least one sleeve member for placing about a well casing stub extending from the sea floor, comprising:

mating means mounted with the template for demountably coupling the template to a complementary end of a drill string extending from a support structure located above the well casing stub; said mating means is positioned near the template assembly center of balance when the template assembly is demountably coupled to the drill string;

the vertical axis of said drill string being essentially parallel to the longitudinal axis of the sleeve member when the drill string is demountably coupled to the template assembly;

said end of the drill string includes a gyroscopic orientation means for detecting the deviation of the template from a desired bearing; and, said mating means maintains the template semi-rigidly coupled to the drill string until the template is controllably released from the drill string;

whereby the rotation of the drill string about the vertical axis of the drill string rotates the template assembly into the desired orientation.

2. The invention of claim 1, wherein said gyroscopic orientation means comprises:

a tubular section having an axial groove to align a gyroscopic means passed through the bore of the drill string for determining the relative bearing of said gyroscopic orientation means.

3. The invention of claim 1, wherein said mating means comprises:

a J-slot for engaging at least one pin mounted with the end of the drill string.

4. The invention of claim 3, wherein said J-slot is formed to controllably release the template from the end of the drill string upon the lifting of the drill string following the lowering of the drill string after the template had contacted the sea floor.

5. The invention of claim 3, wherein said J-slot is formed to controllably release the template from the end of the drill string upon the lifting of the drill string following the lowering of the drill string after the template had contacted the sea floor.

6. The invention of claim 1, wherein said mating means comprises:

a rod for engaging a J-slot formed in the end of the drill string.

7. A method for precision placement of a template of the type having at least one sleeve member for placing about a well casing stub extending from the sea floor, comprising the steps of:

semi-rigidly coupling a mating means mounted with the template for demountably coupling the template to a complementary end of a drill string;

lowering the drill string with the template demountably coupled thereto until the template is in proximity to the sea floor;

determining the orientation of a selected axis of the template relative to a desired heading;

rotating the drill string about the vertical axis until the desired orientation of the template is achieved;

lowering the drill string until the template contacts the sea floor; and then, remotely releasing the drill string from the template.

8. The invention of claim 7, wherein said end of the drill string includes:

gyroscopic orientation means for detecting the deviation of the template from a desired bearing.

9. The invention of claim 8, wherein said gryoscopic orientation means comprises:

a tubular section having an axial groove to align a gyroscopic means passed through the bore of the drill string for determining the relative bearing of said gyroscopic orientation means.

10. The invention of claim 7, wherein said mating means comprises:

a J-slot for engaging at least one pin mounted with the end of the drill string.

11. The invention of claim 10, wherein the J-slot is formed in the walls of a tubular element positioned at the template assembly center of balance with the template assembly is demountably coupled to the drill string.

12. The invention of claim 10, wherein said J-slot is formed to controllably release the template from the end of the drill string upon the lifting of the drill string following the lowering of the drill string after the template had contacted the sea floor.

13. The invention of claim 10, wherein said J-slot is formed to controllably release the template from the end of the drill string upon the lifting of the drill string following the lowering of the drill string after the template had contacted the sea floor.

14. The invention of claim 7, wherein said mating means comprises:

a rod for engaging a J-slot formed in the end of the drill string.

* * * * *

UNITED STATES PATENT AND TRADEMARK OFFICE

CERTIFICATE OF CORRECTION

PATENT NO. : 4,625,804

DATED : Dec. 2, 1986

INVENTOR(S) : Grady G. Allen, Jr.

It is certified that error appears in the above-identified patent and that said Letters Patent is hereby corrected as shown below:

Column 2, line 50, change "relates" to --related--.

Column 3, line 20, change "wall" to --well--.

Column 4, line 52, change "rest" to --rests--.

Column 6, line 50, Claim 11, change "with" to --when--.

Signed and Sealed this

Tenth Day of March, 1987

*Attest:*

DONALD J. QUIGG

*Attesting Officer*

*Commissioner of Patents and Trademarks*